United States Patent [19]

Gutridge et al.

[11] 4,018,166

[45] Apr. 19, 1977

[54] COMBINATION SEAT AND BERTH

[75] Inventors: Jack E. Gutridge, Dyer; Walter J. Marulic, Gary, both of Ind.

[73] Assignee: Pullman Incorporated, Chicago, Ill.

[22] Filed: Mar. 29, 1976

[21] Appl. No.: 671,237

[52] U.S. Cl. ..... 105/316; 5/9 R; 5/18 R; 296/69; 297/343

[51] Int. Cl.[2] ..... B61D 1/02

[58] Field of Search ..... 105/314, 315, 316, 319; 296/65 R, 69; 297/343; 5/3, 5, 8, 9 R, 9 B, 18 R, 18 B

[56] References Cited

UNITED STATES PATENTS

| | | | |
|---|---|---|---|
| 638,466 | 12/1899 | Kelly | 297/343 X |
| 1,414,637 | 5/1922 | Gell | 297/343 |
| 2,504,645 | 4/1950 | Burnett | 105/315 X |
| 2,953,103 | 9/1960 | Bohannon et al. | 105/315 |

*Primary Examiner*—Robert J. Spar
*Assistant Examiner*—Randolph A. Reese
*Attorney, Agent, or Firm*—Richard J. Myers

[57] ABSTRACT

A railway passenger compartment includes a seating arrangement which is convertible to elongated berths by moving oppositely disposed seats toward each other, the same being hingedly connected to seat backs which are also moved into longitudinal alignment forming berths. Stationary seat supports are provided with tracks which slidingly support cantilevered arms connected to the seats and provide basic supports for the seats when in the berth position.

9 Claims, 6 Drawing Figures

FIG. 3
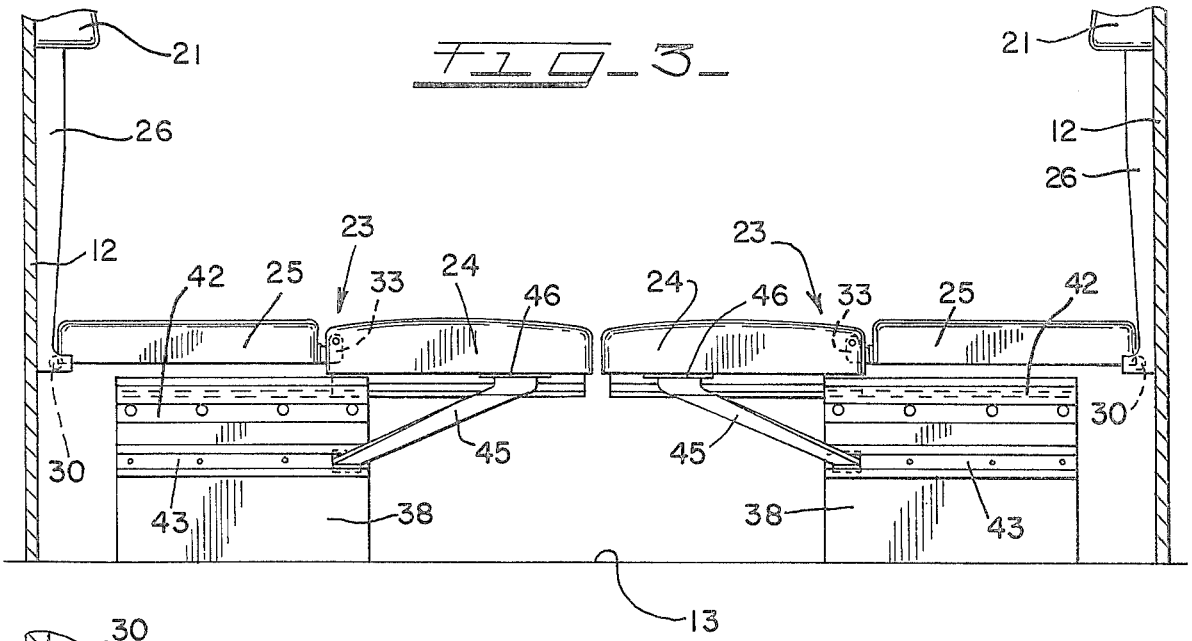
FIG. 8
FIG. 7
FIG. 4
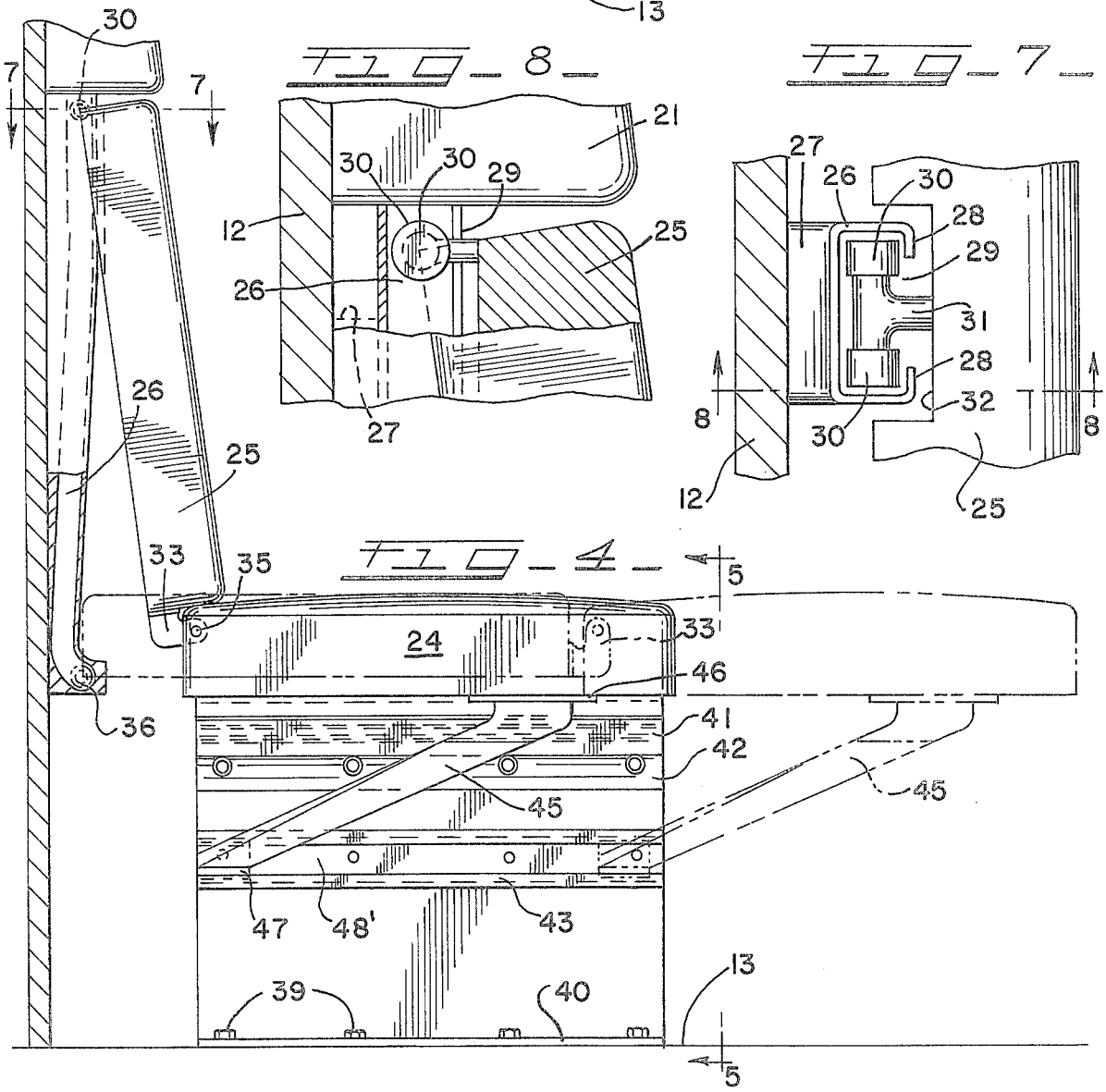

FIG. 5
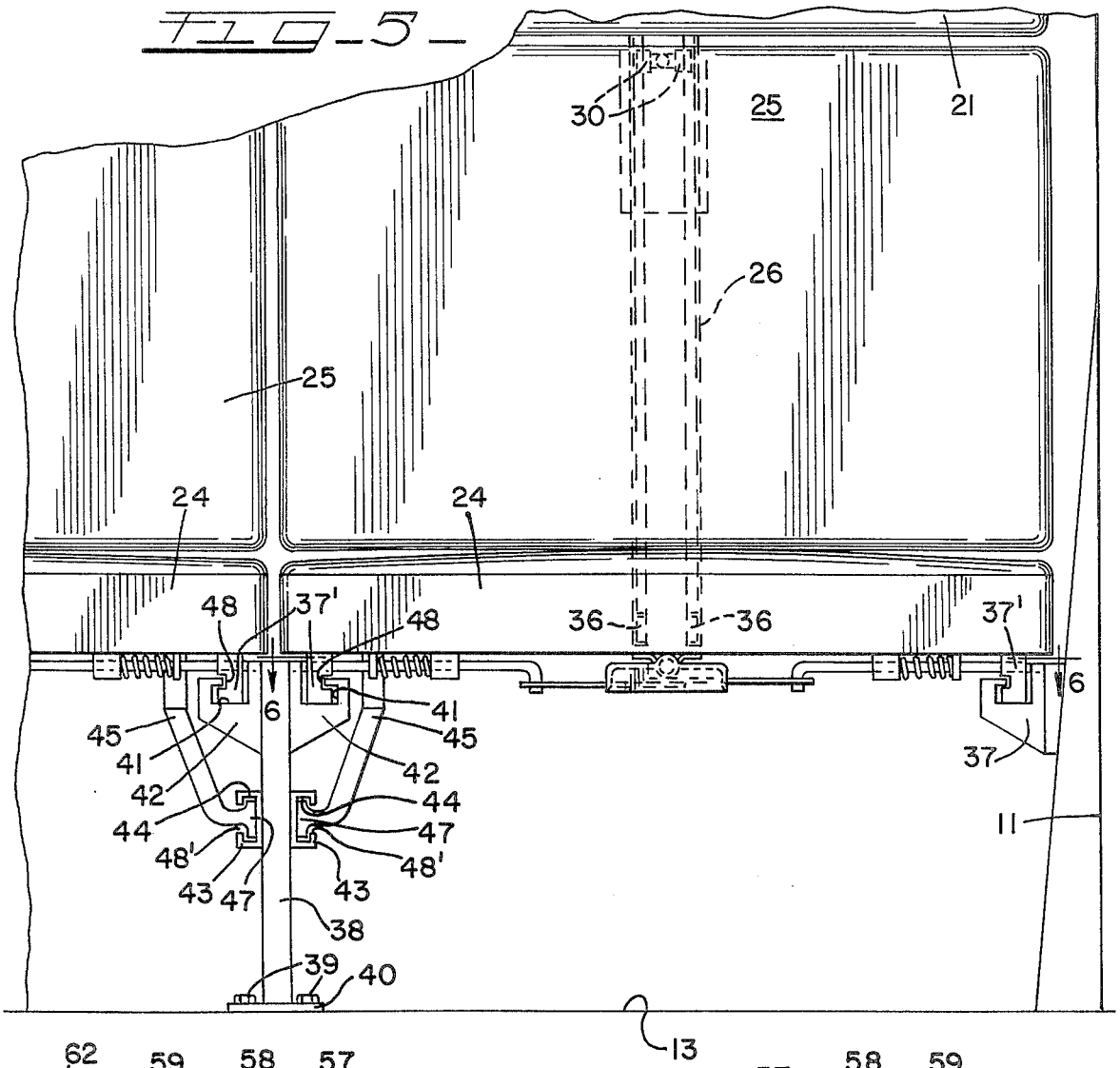
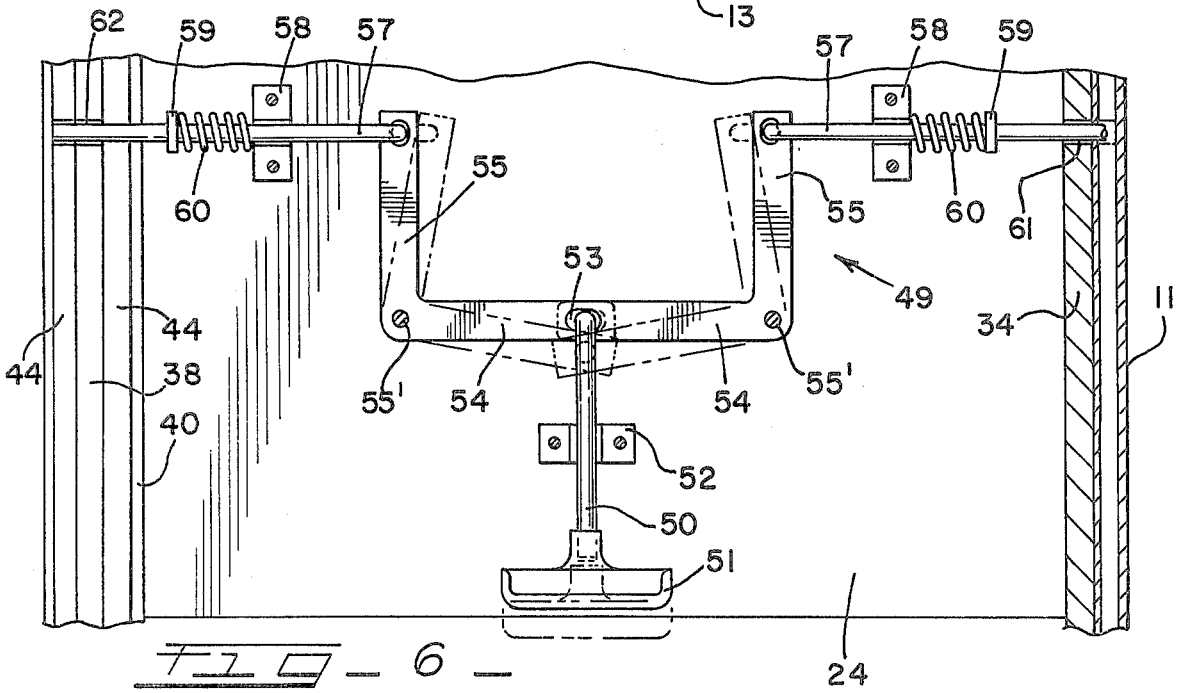
FIG. 6

COMBINATION SEAT AND BERTH

BACKGROUND OF THE INVENTION

1. Field of the Invention

The present construction relates to railway passenger compartments and more particularly to a convertible seating arrangement which is readily converted to sleeping berths.

2. Description of the Prior Art

The prior art is replete with sleeping car seat and berth conversions involving many complex structures for utilizing the seat backs and seats to form elongated berths for passenger use. The present invention relates to a simplified arrangement wherein the objectives of the prior art construction can be achieved in a more efficient and simplified construction.

SUMMARY

In the present invention a passenger car compartment includes a hinged upper berth and a seating arrangement for accommodating four passengers. The seating arrangement comprises pairs of seats which are positioned adjacent longitudinally spaced partition walls with the seats facing each other. The seat backs are hingedly connected to the seats and are guided by vertical tracks supported on the partition walls, downwardly by means of rollers, to a horizontal position, the seats also being inter-connected in hinged relation with the seat backs and being supported on horizontal tracks. The horizontal tracks are provided on side walls of the car and on a divider wall laterally spaced from the side wall. The inner edges of the adjacent seats of each pair are supported by a vertical pedestal which also includes tracks for supporting the seats in sliding relation. Cantilevered arms are provided at the forward edges of the seats which extend in the berth position of the seats rearwardly in diagonal relation and having slide members supported in the tracks which are provided on the vertical pedestal. In the berth position the seats are anchored at their rear portions in the horizontal tracks and the seat backs are supported in the upper track. The cantilevered arms support the forward edges of the seats in a sturdy supporting manner. The seats also include locking and latching mechanisms which are readily available to the operator for releasably locking the seats in the extended or berth position as well as in the seating position.

BRIEF DESCRIPTION OF THE DRAWINGS

FIG. 3 is a elevational view partially in section taken substantially along the line 3—3 of FIG. 2;

FIG. 4 is a side elevational view partially in section of a seat and back arrangement in seating position;

FIG. 5 is a view taken substantially along the line 5—5 of FIG. 4;

FIG. 6 is a cross-sectional view taken substantially along the line 6—6 of FIG. 5;

FIG. 7 is a cross-sectional view taken substantially along the line 7—7 of FIG. 4; and FIG. 8 is a cross-sectional view taken substantially along the line 8—8 of FIG. 7.

Description of the Preferred Embodiment

Figure 1:
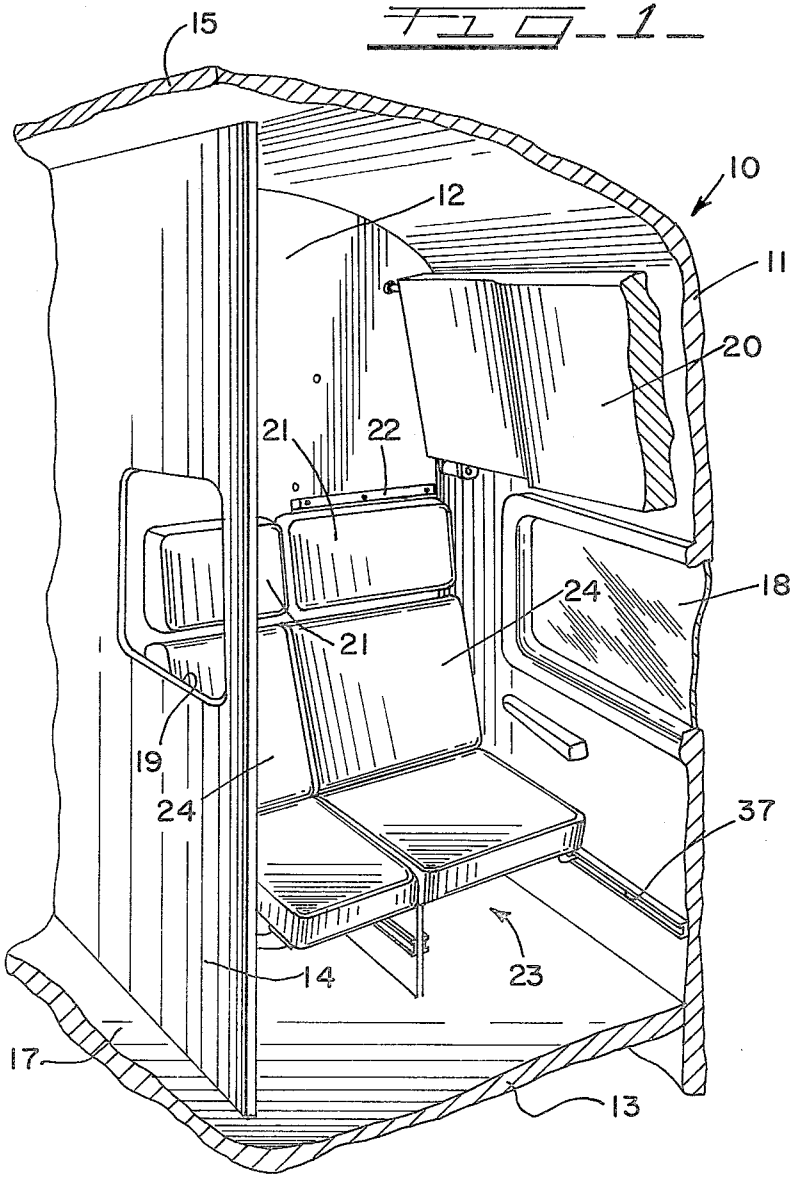
FIG. 1 is a perspective view of a railway passenger car compartment showing a upper sleeping berth in a stored position and disclosing a pair of seats in a seating position.

FIG. 1 discloses approximately one half of a railway car compartment 10, the other half being substantially identical. The compartment 10 includes an outer side wall of the car 11 and transversely extending partition walls 12 only one of which is shown. The compartment 10 includes a car floor 13 and a divider wall 14 extends substantially parallel with respect to the wall 11 and is transversely spaced with respect thereto. A car roof is designated at 15 and the divider wall 14 is positioned to one side of a aisle 17 leading the length of the railway car.

Figure 2:
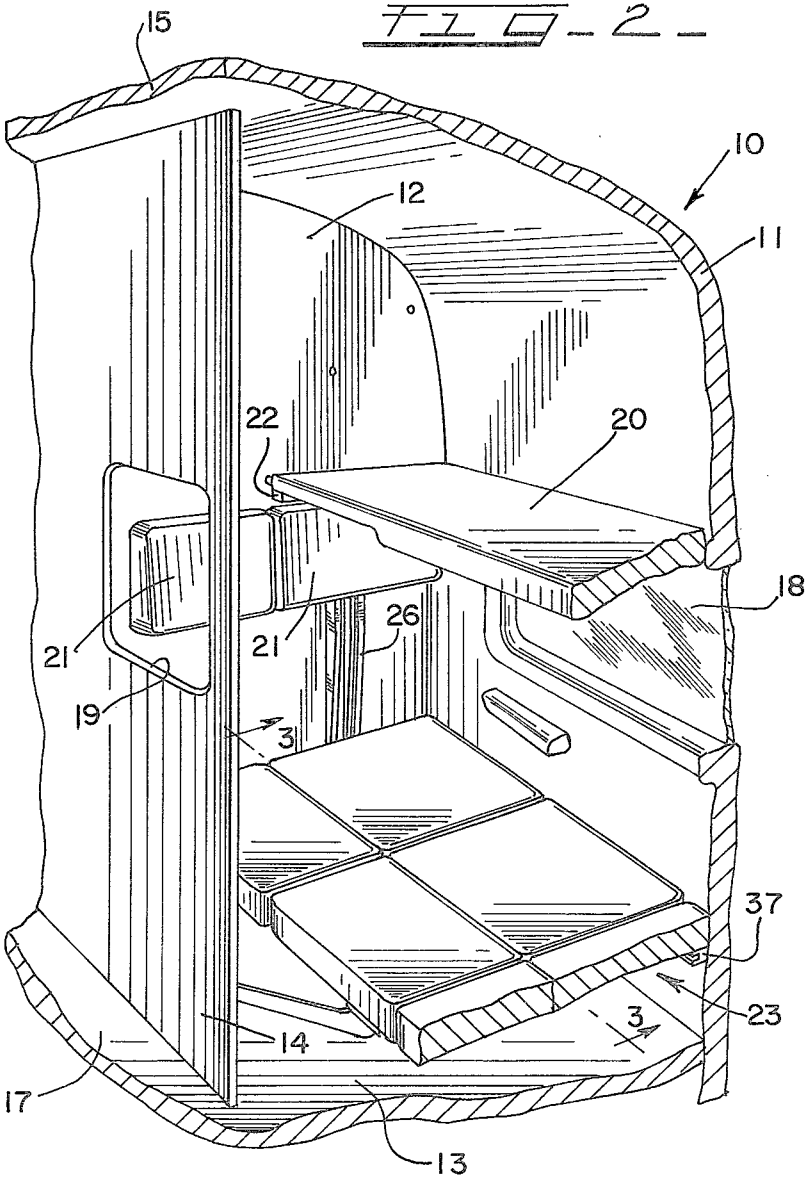
FIG. 2 is a view similar to FIG. 1 showing the upper berth and seating arrangement positioned in use for sleeping accommodation.

The outer wall 11 includes an outer window 18 and the divider wall 14 includes an inner window 19. The compartment includes an upper berth 20 which in FIG. 1 is shown in the stored or non-use position and in FIG. 2 is shown in the sleeping use position. The upper berth 20 is supported on opposite ends thereof by cross bars 22 forming the upper supports for head rest 21. The head rests 21 are included in the seat and berth combinations 23 which are positioned in facing relation in the passenger compartment. The seat and berth combinations 23 includes a pair of seats 24 positioned at opposite ends of the compartment and corresponding seat backs 25. Each partition wall 12 has connected thereto channel shaped vertically extending tracks 26 connected to track supports 27 in turn rigidly secured to the divider walls 14 as shown in FIG. 7. Such a support track 27 is provided for each of the seat backs 25. The track 26 includes inwardly extending flanges providing an elongated slot 29 closed at its lower end as indicated at 36. A pair of rollers 30 are connected to a roller support 31 which in turn is connected within a recess 32 in each seat back 25 for slidingly or rollingly supporting each said seat back on the divider wall. The lower end of each seat back 25 includes a hinged bracket 33 which by means of a hinged pin 35 as best shown in FIG. 4 permits relative hinging of the seat backs 25 and the seats 24.

Each of the combination seat back and seat arrangements includes an upright support pedestal 38 secured to the car floor by means of fasteners 39. On the outer wall 11 adjacent to each seat back combination there is provided a horizontally extending track 37 as best shown in FIGS. 1 and 5. A similar track 37 parallel to the track 37 on the outer wall is provided on the divider wall adjacent each of the seat back combinations. A track follower 37' as best shown in FIG. 5, is connected to the underneath portion of each seat 24 and is slidingly and lockably engaged within the track 37.

As best shown in FIG. 5 the fasteners 39 extend through a plate 40 secured to the lower part of the support pedestal 38 to secure the same to the car floor 13. The upper end of the pedestal 38 is provided with upper tracks generally designated at 41 forming part of brackets 42. Such brackets 42 are disposed on the upper opposite sides of the pedestal 38 to form supports for the adjacent seats 24. Each of the seats is provided at its lower surface with track followers 37' which extend through upper slots 48 provided in each of the brackets 42. The track followers 37' are suitably inter-locked with and slidingly are supported on the brackets 42.

A pair of lower brackets 43 of channel-shaped construction are carried on opposite sides of the pedestal 38. Each of the brackets 43 is provided with a track 44. An arm 45 is connected by means of a flat securing plate 46 to a forward and side portion of each of the seats 24 and extend downwardly and rearwardly in cantilevered fashion as best shown in FIGS. 3 and 4. Each of the arms 45 also includes a lower slide bracket 47 of T-shaped construction which as best shown in FIG. 5 is secured in the tracks 44 and project outwardly through slots 48'. Thus, it is apparent that the seats are supported in sliding relation on the brackets 37 and 42 and that the seats futher are supported by the cantilever arms 45 on the slide brackets 43.

Each of the seats 24 has connected on its underneath surface a latching mechanism generally designated at 49. Each latching mechanism 49 includes a hand operated plunger rod 50 easily operated by the passenger grasping the handle 51. The plunger rod is movably supported on a bracket 52 and the end of the rod 50 engages openings 53 provided at arms 54 of bell crank levers 55 supported on pivots 55' on the underneath surfaces of the seats 24. Each of the bell crank levers 55 is pivotally connected to lock rods 57 which are slidingly supported by means of brackets 58 on the seats 24. The rods 57 are reciprocated during reciprocation of the rod 50 and handle 51. Stop members 59 are engaged by springs 60 anchored on the brackets 58, the said springs 60 urging the rods 57 into stop openings 61 provided in the wall liner 34 supported on a wall 11 and stop openings 62 provided on the vertical pedestals 38.

OPERATION

FIG. 2 shows the compartment in condition for sleeping use with the upper berth lowered onto the brackets 22 which firmly support the berth. In order to place the seats in the horizontal position shown in FIG. 2, the operator merely grasps the handle 51 and pulls it outwardly to the disengaging position shown in dotted lines in FIG. 6, whereupon the rods 57 are released from the stop openings 61 and 62 and the seat now moves forwardly on the tracks 37 and 41 with the forward portion of the seat being supported by means of the arms 45 on the tracks 44. Thus, each seat will easily slide forwardly and in so doing each seat back 25 is moved to a horizontal position with the rollers 30 moving downwardly in the track 26 to the lower closed end 36 whereupon each seat back is also in a horizontal position and the seats are ready for sleeping occupancy. As best shown in FIG. 3, the seats are securely supported by means of the cantilever arms 45 on the front ends while the rear ends of the seats continue to be supported on the pedestal.

To again place the compartment in its sitting condition the afore-mentioned process is merely reversed.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A railway car passenger compartment including an outer side wall;

longitudinally spaced laterally extending partition walls, and a divider wall extending longitudinally in laterally spaced relation with respect to said outer wall, the improvement comprising a convertible seating arrangement including;

a seat back, adjacent each of said partitions, a seat disposed below each seat back;

means slidingly supporting each said seat back on each said partition wall for movement from an upright position to a lowered horizontal position, means hingedly connecting said seat backs to each said seat, a seat support pedestal vertically and longitudinally supported within said compartment below each said seat, first upper and lower horizontal tracks mounted on said pedestals, upper second tracks supported on said outer side wall, upper slide brackets on said seats slidingly supported on said first and second upper tracks, a support arm for each seat, said support arms being connected adjacent forward portions of said seats and extending diagonally downwardly and rearwardly, and slide means on said arms slidingly engaging said lower track, whereby in the horizontal position of said backs and seats, said seats extend forwardly from said pedestals and are supported thereon in cantilevered relation, and said backs and seats providing a horizontal continous lower berth.

2. The invention in accordance with claim 1, said means slidingly connecting said seat backs to said partition walls including upright guide tracks on said partition walls, and guide rollers on said seat backs engaging upright tracks.

3. The invention in accordance with claim 2, said guide tracks having closed lower ends for retaining said rollers in said tracks during the horizontal position of said seat backs.

4. The invention in accordance with claim 3, including releasable latch means on each of said seats for releasably locking said seats in a seating or reclining position.

5. The invention in accordance with claim 4, said latch means being connected to the underneath side of said seat.

6. The invention in accordance with claim 5, said latch means including a hand operated lever, and linkage means connected to said lever and including a locking rod adapted to releasably engage keeper means on said pedestal.

7. The invention in accordance with claim 6, said latch means including a bell crank arm connected to said hand lever and said locking rod.

8. The invention in accordance with claim 7, said latch means including biasing means for biasing said locking rods into engagement with said keeper means.

9. The invention in accordance with claim 8, each said seat having a second bell crank arm and locking rod arrangement connected to and actuated by said hand lever, and second keeper means on said outer wall engaged by said second locking rod.

* * * * *